US006484425B1

(12) United States Patent
Hirsch

(10) Patent No.: US 6,484,425 B1
(45) Date of Patent: Nov. 26, 2002

(54) FLUID DISPLAY COVER ASSEMBLY

(75) Inventor: Michael Hirsch, Pischeidorf (AT)

(73) Assignee: Telephone Products, Inc., Wheeling, IL (US)

( * ) Notice: Subject to any disclaimer, the term of this patent is extended or adjusted under 35 U.S.C. 154(b) by 0 days.

(21) Appl. No.: 09/488,896

(22) Filed: Jan. 21, 2000

(51) Int. Cl.[7] ..... B42D 29/00; A63A 33/00

(52) U.S. Cl. ..... 40/406; 281/29; 281/37; 281/51

(58) Field of Search ..... 46/406; 281/29, 281/37, 51; 446/267, 227

(56) References Cited

U.S. PATENT DOCUMENTS

| | | | | | |
|---|---|---|---|---|---|
| 3,738,036 | A | * | 6/1973 | Landsinger et al. | 40/406 |
| 4,951,404 | A | * | 8/1990 | Lithwick | 40/124.09 |
| 5,195,918 | A | * | 3/1993 | Mozes | 446/227 |
| 5,462,006 | A | * | 10/1995 | Thiruppathi | 116/234 |
| 5,607,101 | A | * | 3/1997 | Saito | 229/71 |
| D389,181 | S | * | 1/1998 | Fernandes et al. | D19/26 |
| 5,704,646 | A | * | 1/1998 | Tzeng | 281/29 |
| 5,915,729 | A | * | 6/1999 | Vap | 281/22 |
| 5,941,570 | A | * | 8/1999 | Cole et al. | 281/38 |
| 5,948,520 | A | | 9/1999 | Hirsch | 428/304.4 |
| 5,975,578 | A | * | 11/1999 | Mayer | 281/37 |
| 6,076,675 | A | * | 6/2000 | Pawlowski | 206/459.5 |
| 6,106,909 | A | | 8/2000 | Hirsch | 428/13 |
| 6,183,823 | B1 | | 2/2001 | Hirsch | 428/13 |
| 6,203,642 | B1 | | 3/2001 | Hirsch | 156/145 |

* cited by examiner

*Primary Examiner*—Cassandra H. Davis
(74) *Attorney, Agent, or Firm*—Welsh & Katz, Ltd.; Thomas W. Tolpin; Leonard Friedman

(57) ABSTRACT

A fluid display cover assembly comprising a sealed container coupled to a cover such as a notebook cover. The container has a light-transmissive front, and encloses a fluid comprising a gas, a liquid, or a plurality of gases and/or liquids. There also can be solid objects within the container. The cover can include a cutaway section replaced by the container. Displays within the container, on the cover, or below the cover can be visible through the front of the container.

10 Claims, 6 Drawing Sheets

FLUID DISPLAY COVER ASSEMBLY

BACKGROUND OF THE INVENTION

The present invention relates to covers for notebooks, binders and the like and, more particularly, to a display for a cover.

There are many different covers for articles such as pads, notebooks, calendars, menus, books, albums and so forth. Some of such articles are inexpensive and include folded paper products. Other such articles may be more expensive and comprise finely bound leather.

It is desirable to provide a cover with an attractive display.

SUMMARY OF THE INVENTION

An improved display assembly is provided which comprises: (1) an article for holding at least one item, and (2) a sealed container which cooperates with and is coupled to the article for containing matter comprising at least one liquid, gas, or solid object, or a combination thereof. The article can comprise: a mouse pad, a deskmat, a keychain, a clipboard, a coaster, a refrigerator magnet, or an article with a cover. The container can be or have a portion which is: opaque, translucent, transparent, rigid, or flexible.

In one preferred form, the improved display assembly features an improved, aesthetically appealing, fluid display cover assembly which comprises an attractive display coupled to a cover of an article, such as a notebook, binder, pad, etc. for holding paper or other items. The fluid display cover assembly of the present invention includes a sealed container with a light-transmissive front that provides a window for viewing a fluid comprising one or more liquids and/or gases within the container. The cover can include a cutaway section about the container. Displays within the container can include different fluids, and can include stationary or movable solid objects dispersed in the fluid. In addition to displays within the container, different embodiments can include displays below the cover, and/or on the cover but beneath the container, which can be visible through the front of the container.

The features of the present invention which are believed to be novel are set forth below with particularity in the appended claims. The invention, together with further advantages thereof, may be understood by reference to the following description in conjunction with the accompanying figures, which illustrate some embodiments of the invention.

DETAILED DESCRIPTION OF THE PREFERRED EMBODIMENTS

Figure 1:
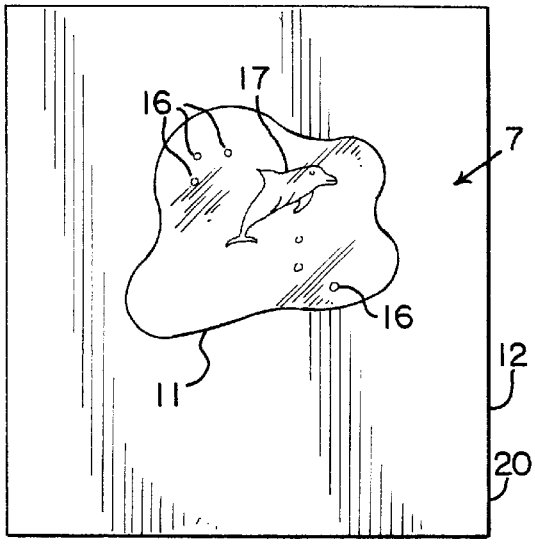
FIG. 1 is a front view of a fluid display cover assembly comprising a cover with an irregularly shaped container containing a liquid, gas bubbles, and a solid object in accordance with principles of the present invention.
Figure 2:
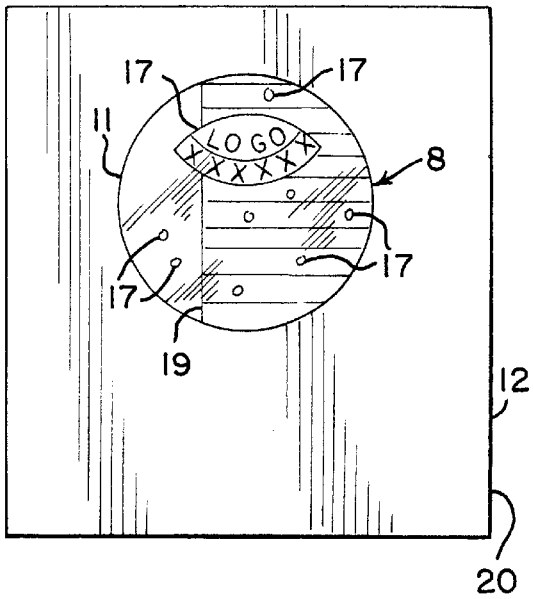
FIG. 2 is a front view of another fluid display cover assembly with a fluid and solid objects within a circular container, which extends through and below a cover in accordance with principles of the present invention.
Figure 3:
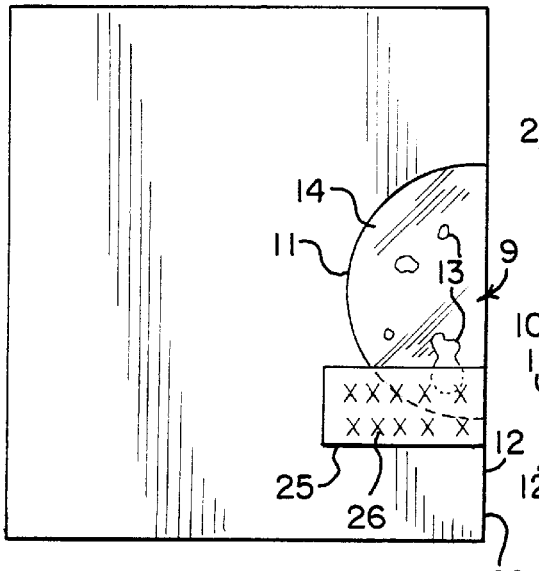
FIG. 3 is a front view of a further fluid display cover assembly comprising a cover with a semi-circular container with two immiscible liquids and a supplemental slot, pocket, or sleeve for a business card, photograph, etc. in accordance with principles of the present invention.
Figure 4:
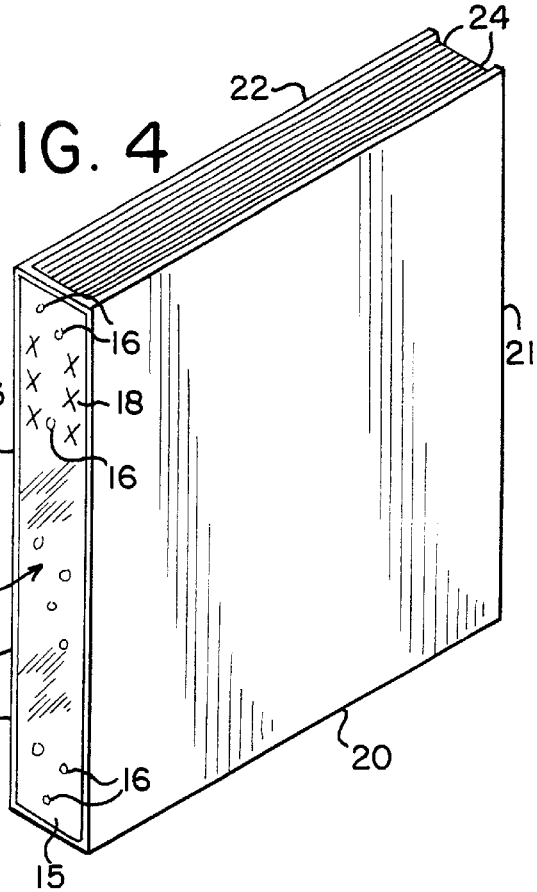
FIG. 4 is a perspective view of still another fluid display cover assembly with liquid and gas bubbles in a container on a cover comprising a spine of an article in accordance with principles of the present invention.
Figure 5:
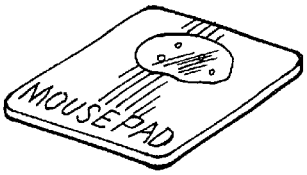
FIG. 5 is a perspective view of a mouse pad.
Figure 6:
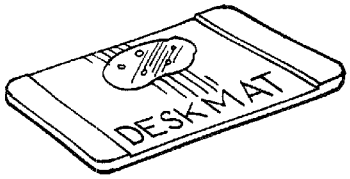
FIG. 6 is a perspective view of a desk mat.
Figure 7:
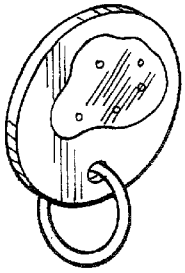
FIG. 7 is a perspective view of a key chain.
Figure 8:
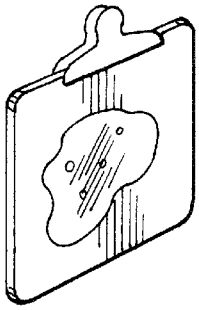
FIG. 8 is a perspective view of a clipboard holder.
Figure 9:
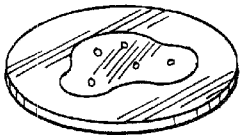
FIG. 9 is a perspective view of a coaster.
Figure 10:
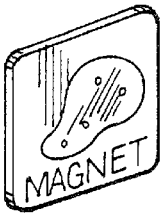
FIG. 10 is a perspective view of a refrigerator magnet.
Figure 11:
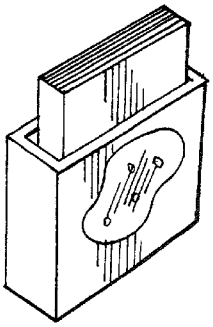
FIG. 11 is a perspective view of a pad holder.
Figure 12:
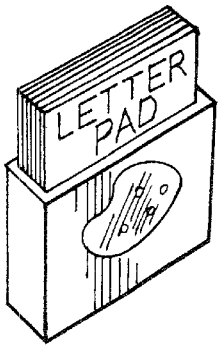
FIG. 12 is a perspective view of a letter pad holder.
Figure 13:
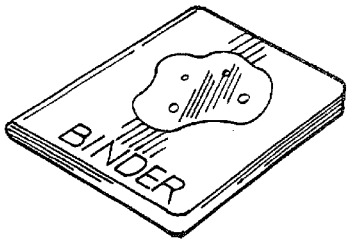
FIG. 13 is a perspective view of a binder.
Figure 14:
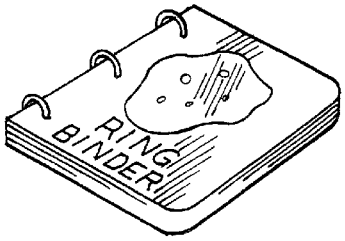
FIG. 14 is a perspective view of a ring binder.
Figure 15:
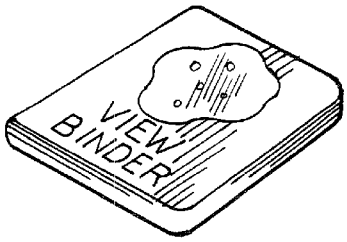
FIG. 15 is a perspective view of a view-binder.
Figure 16:
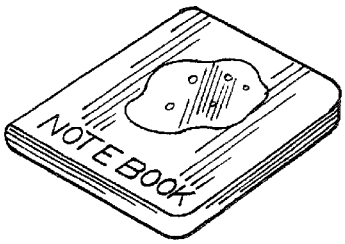
FIG. 16 is a perspective view of a notebook.
Figure 17:
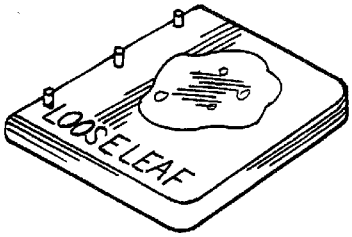
FIG. 17 is a perspective view of a loose-leaf notebook.
Figure 18:
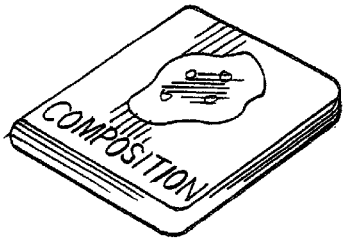
FIG. 18 is a perspective view of a composition book.
Figure 19:
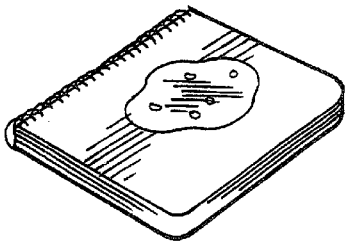
FIG. 19 is a perspective view of a spiral-bound book.
Figure 20:
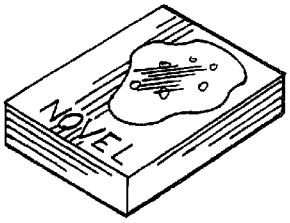
FIG. 20 is a perspective view of a paperback book.
Figure 21:
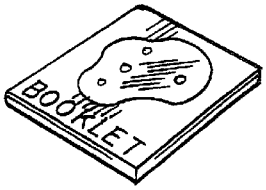
FIG. 21 is a perspective view of a booklet.
Figure 22:
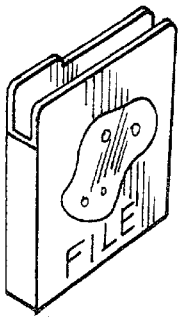
FIG. 22 is a perspective view of a file.
Figure 23:
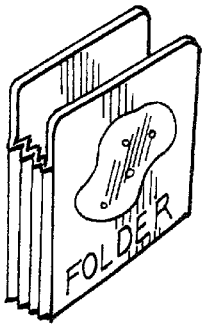
FIG. 23 is a perspective view of a folder.
Figure 24:
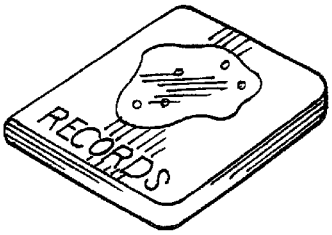
FIG. 24 is a perspective view of a record book.
Figure 25:
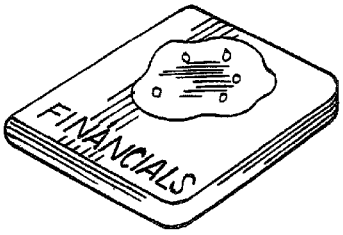
FIG. 25 is a perspective view of a financial book.
Figure 26:
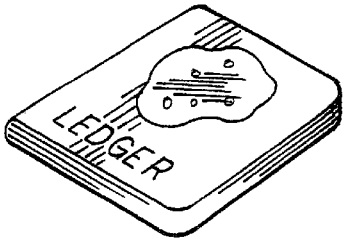
FIG. 26 is a perspective view of a ledger.
Figure 27:
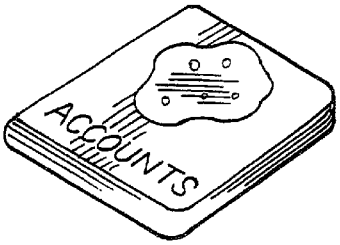
FIG. 27 is a perspective view of an accounting book.
Figure 28:
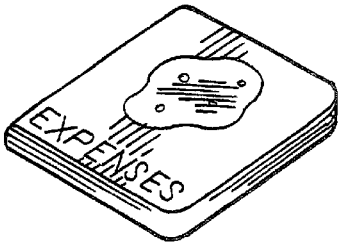
FIG. 28 is a perspective view of an expense book.
Figure 29:
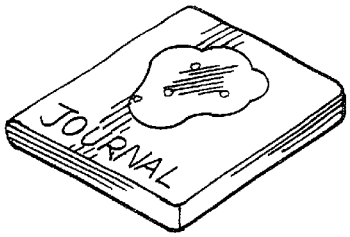
FIG. 29 is a perspective view of a journal.
Figure 30:
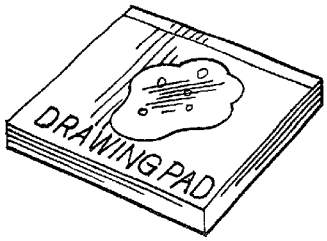
FIG. 30 is a perspective view of a drawing pad holder.
Figure 31:
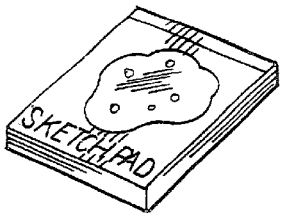
FIG. 31 is a perspective view of a sketch pad holder.
Figure 32:
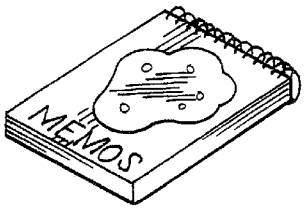
FIG. 32 is a perspective view of a memo book.
Figure 33:
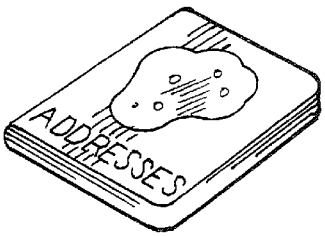
FIG. 33 is a perspective view of an address book.
Figure 34:
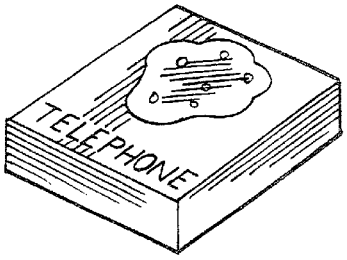
FIG. 34 is a perspective view of a telephone book.
Figure 35:
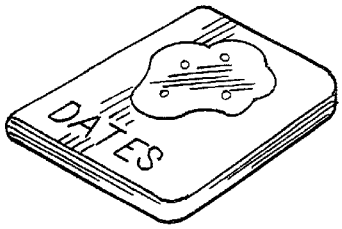
FIG. 35 is a perspective view of a date book.
Figure 36:
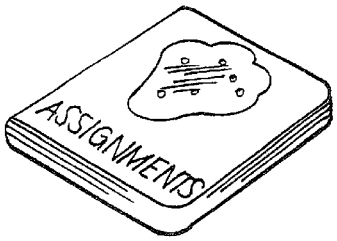
FIG. 36 is a perspective view of an assignment book.
Figure 37:
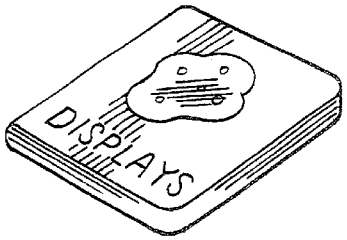
FIG. 37 is a perspective view of a display book.
Figure 38:
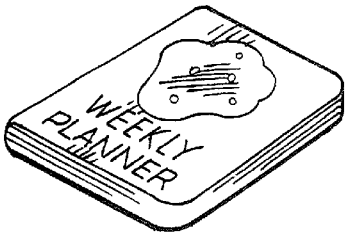
FIG. 38 is a perspective view of a weekly planner.
Figure 39:
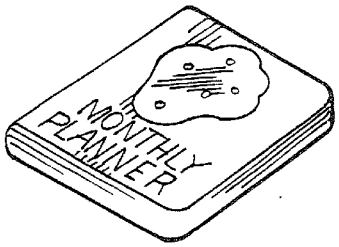
FIG. 39 is a perspective view of a monthly planner.
Figure 40:
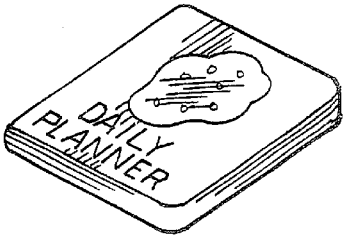
FIG. 40 is a perspective view of a daily planner.
Figure 41:
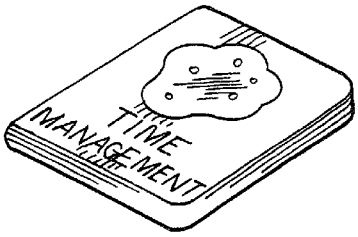
FIG. 41 is a perspective view of a time-management book.
Figure 42:
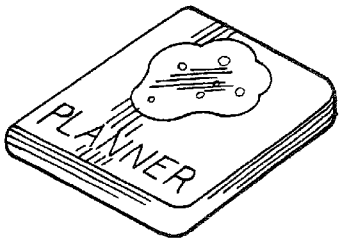
FIG. 42 is a perspective view of a planner.
Figure 43:
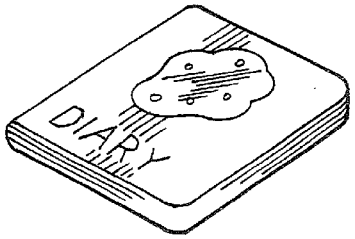
FIG. 43 is a perspective view of a diary.
Figure 44:
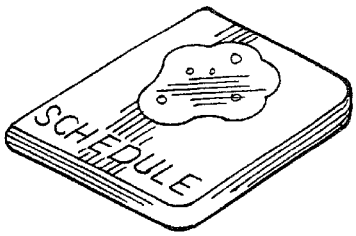
FIG. 44 is a perspective view of a schedule book.
Figure 45:
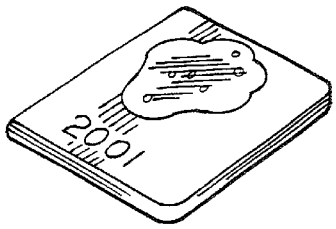
FIG. 45 is a perspective view of a pocket calendar.
Figure 46:
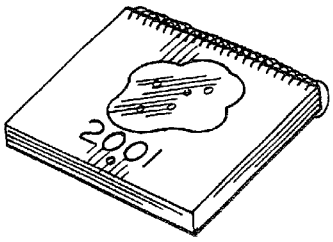
FIG. 46 is a perspective view of a calendar.
Figure 47:
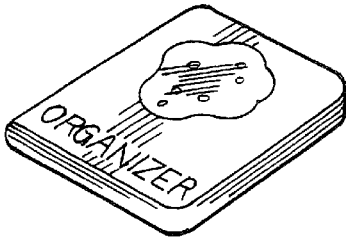
FIG. 47 is a perspective view of an organizer book.
Figure 48:
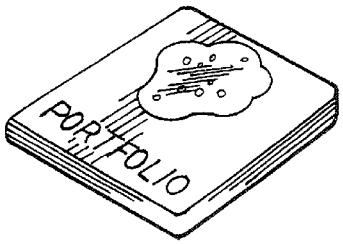
FIG. 48 is a perspective view of a portfolio pad holder.
Figure 49:
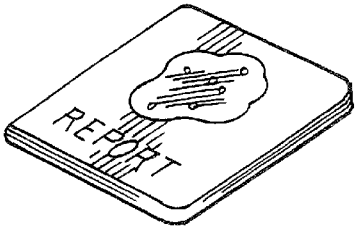
FIG. 49 is a perspective view of a report protector.
Figure 50:
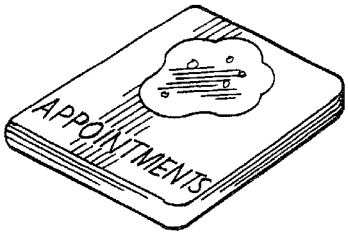
FIG. 50 is a perspective view of an appointment book.
Figure 51:
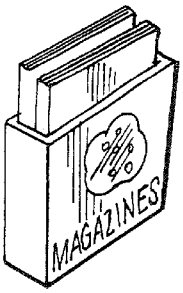
FIG. 51 is a perspective view of a magazine holder.
Figure 52:
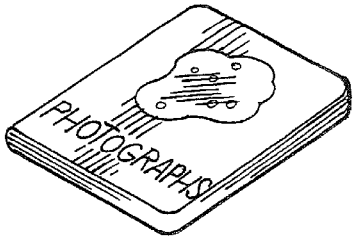
FIG. 52 is a perspective view of a photo album.
Figure 53:
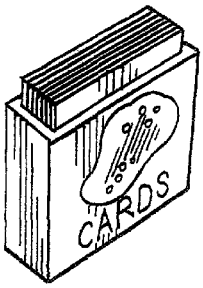
FIG. 53 is a perspective view of a card holder.
Figure 54:
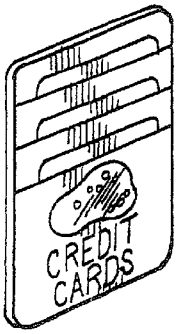
FIG. 54 is a perspective view of a credit card holder.
Figure 55:
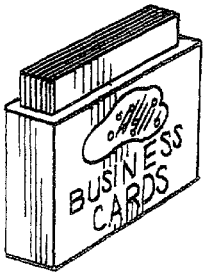
FIG. 55 is a perspective view of a business card holder.
Figure 56:
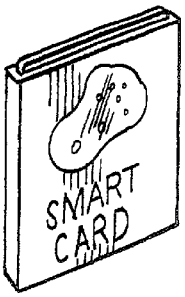
FIG. 56 is a perspective view of a smartcard holder.
Figure 57:
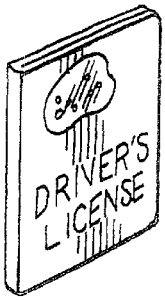
FIG. 57 is a perspective view of a driver license holder.
Figure 58:
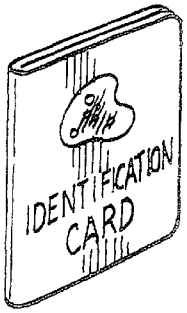
FIG. 58 is a perspective view of an identification card holder.
Figure 59:
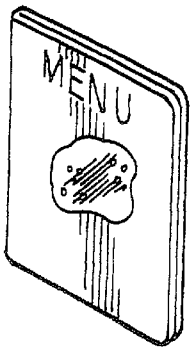
FIG. 59 is a perspective view of a menu.
Figure 60:
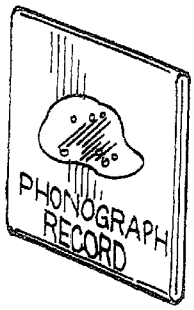
FIG. 60 is a perspective view of a phonograph jacket.
Figure 61:
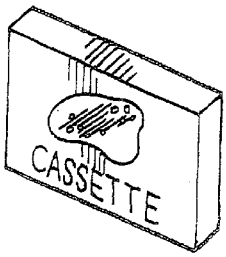
FIG. 61 is a perspective view of a cassette holder.
Figure 62:
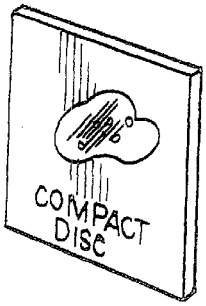
FIG. 62 is a perspective view of a compact disc holder.

FIGS. 1 through 4 show examples of fluid display cover assemblies 7 through 10. Each of the fluid display cover assemblies has fluidly-sealed, fluid-impervious container 11 which is coupled, sealed, fixedly attached and securely connected to a cover 12. The container 11 can have an irregular shape as shown in FIG. 1, be circular as shown in FIG. 2, be semicircular as shown in FIG. 3, be a rectangle as shown in FIG. 4, or can be other shapes or configurations.

The container 11 can comprise a front and a back which are sealed to each other around the edge of at least one of the front and the back. There is space between the front and the back of the container 11 except around the edge where they are sealed. As an example, the container 11 can be a plastic such as polyvinyl chloride, polyethylene, or polypropylene. Other materials can be used. At least the front is light-transmissive such as a transparent plastic, for viewing the display.

The container 11 can be flexible, and can be in the form of a pouch, an envelope, a bag, a sleeve, or a pocket. In different embodiments, the container 11 could exist separately from the cover 12 before it is coupled to the cover 12. Alternatively, one surface, or part of one surface, of the cover 12 (such as a display surface or an opposing surface of the cover 12) could constitute an integral part of the container 11 (such as a front or a back of the container 11).

In different embodiments, the cover 12 can be rigid or flexible. As examples, the cover 12 could be composed of leather, plastic, paper, cardboard or paperboard.

The display surface of the cover 12 can be generally planar or flat before the container 11 is coupled to it, or the cover 12 may be cut out partially through the thickness of the cover 12 to accommodate at least in part the shape of the container 11. Alternatively, a section of the cover 12 can be cut out entirely through the thickness of the cover, and the cutaway section can be occupied at least partially by the container 11. Preferably, the edge of the cutaway section peripherally surrounds and is securely coupled to the edge around the container 11.

The container 11 can be coupled to the display surface of the cover 12. If there is a cutaway section entirely through the thickness of the cover 12, the container 11 can be coupled to an opposing surface of the cover 12 and still be visible through the cutaway section. If there is any cutaway section, the container 11 can be coupled to the cover 12 between the display and opposing surfaces of the cover 12. The display surface can be an outside surface or an inside surface of the cover 12. The container 11 can be coupled to the cover 12 in various known ways such as high frequency sonic welding, other heat sealing, press-fitting, use of fasteners, or use of an adhesive. In particular embodiments, some coupling ways may work better than others because of the particular materials of which the cover 12 and the container 11 are composed.

The space between the front and back of the container 11 contains a fluid which can constitute viewable matter for at least part of a display. For example, the fluid can be a liquid solution such as glycerin and water. Other fluids can be used. The fluid can be a gas, a liquid, or a plurality of gases and/or liquids. For example, the gas(es) can comprise colored gas, transparent gas, translucent gas, air, smoke, or carbon dioxide.

The fluid in the container 11 can be transparent, translucent, or opaque. It also can contain a dye. In some embodiments, there can be a plurality of immiscible liquids in the container 11, such as oil and water. Two immiscible liquids can retain different appearances, especially if they are different colors, only one includes a dye, or one includes a dye with a higher concentration than the other. FIG. 3 is an example of the appearance of two immiscible liquids 13 and 14 within the container 11.

As shown in the examples of FIGS. 1 and 4, the container 11 can be filled partially with liquid 15, leaving gas bubbles 16 visible in the container 11 which are not dissolved in the liquid. The bubbles 16 can comprise air and/or other gases. In one embodiment, the liquid can be carbonated.

As shown in the examples of FIGS. 1 and 2, there can be solid objects 17 in the container 11. The solid objects 17 can be movable. The solid objects 17 can be a dispersion of small particles such as glitter, as illustrated by the small objects 17 in FIG. 2. The solid objects 17 can be suspended particles. The solid objects 17 can be floatable materials. The solid objects 17 can be any objects such as plastic strips, colored plastic, particulates, sponge, rubber, metal, beans, pellets, or chips. The solid objects 17 can be fluid-impermeable materials. The solid objects 17 can also be imperforate, perforated or foraminous, or of different densities. The solid objects 17 can display different shapes and designs including pictures, writings, or other indicia. For example, they can appear as fish as illustrated in FIG. 1, or they can display trademarks or company logos as suggested by the large object 17 in FIG. 2.

At least the front of the container 11 is light-transmissive, so that the display within the container 11 is visible. This could include different fluids and solid objects. In some embodiments, the appearance of the back of the container 11, or at least an inner surface of the back, could also be visible through the contents and the front of the container 11. In some embodiments such as in the example of FIG. 4, the entire container 11 can be light-transmissive, preferably transparent, and an additional display 18 of the display surface of the cover 12 underneath the container 11 can be visible through the container 11. If there is a cutaway section entirely through the thickness of the cover 12, an additional display 19 of an object on the other side of the cover 12 can be visible through the container 11, as in the example of FIG. 2.

The cover 12 can be a cover for any article 20, such as an article for holding any paper such as paper sheets, paper pages, a pad of paper, lined paper, and printed paper, or for holding any other item(s). For example, cover 12 could be a cover for a pad, a letter pad, a binder, a ring binder, a multiple-ring binder, a view-binder, a clipboard, a notebook, a loose-leaf notebook, a book, a composition book, a spiral-bound book, a hard-bound book, a paperback book, a booklet, a file, a folder, a presentation folder, a record book, a financial book, a ledger, an accounting book., an expense book, a journal, a drawing pad, a sketch pad, a memo book, an address book, a telephone book, a date book, an assignment book, a display book, a weekly planner, a monthly planner, a daily planner, a time-management book, a planner, a diary, a schedule book, a pocket calendar, a calendar, an organizer book, a portfolio pad, a report protector, an appointment book, a magazine holder, a photo album, a menu, a box, a phonograph, a cassette, a compact disc, or one or more cards, credit cards, business cards, smartcards, driver licenses, or identification cards. It could be a cover for any receptacle or protector.

The cover 12 can comprise different parts of such an article 20, such as the front, spine, or the back of a binder.

As an example, FIG. 4 shows an article 20 which is a book with a front cover 21, a back cover 22, and a spine 23 covering pages 24 of the book. The spine 23 also constitutes a cover 12, and a container 11 is coupled over the entire spine 23. An additional display 18 on the spine 23 can be visible through the container 11. Other containers with fluid displays (and/or with solid objects) could be coupled to other parts of the book such as the front cover 21. For example, the front cover 21 could look like one of the covers 12 illustrated by FIGS. 1 through 3.

In additional embodiments, the cover 12 can include an auxiliary or supplemental sleeve, pocket, or slot 25 (FIG. 3) with an auxiliary or supplemental light-transmissive top or front for accommodating an additional display 26. For example, a business card or a photograph could be inserted in the auxiliary sleeve 25. In some embodiments, a bottom of the auxiliary sleeve 25 and/or the additional display 26 within auxiliary sleeve 25 can also be light-transmissive. In some examples, auxiliary sleeve 25 could overlap container 11 at least partially. Auxiliary sleeve 25 could be on top of container 11 as in FIG. 3. It also could be underneath the container 11, or on a back surface of cover 12 or between display and opposing surfaces of cover 12.

As an example of constructing one embodiment, a cutaway section can be die-cut in the cover 12. The cutaway section can be any shape or size, and can be located anywhere on the cover 12. A first side (a front or a back) of the container 11 can be placed on a welding die with a depression to keep a liquid in place. The other side of the container can be placed above the liquid and welded to the first side of the container 11. The container 11 can be high frequency welded with about a 3 mm welding edge for later assembly with the cover 12. The upper die can include a cutting edge to remove excess material outside of the welding edge.

The embodiments discussed and/or illustrated are examples. They are not exclusive ways to practice the present invention, and it should be understood that there is no intent to limit the invention by such disclosure. Rather, it is intended to cover all modifications and alternative constructions and embodiments that fall within the scope of the invention as defined in the following claims.

I claim:

1. A fluid display assembly, comprising:

at least one paper item without any cutaway section; and a paper-supporting assembly for supporting and protecting the at least one item, said paper-supporting assembly comprising:

a cover for at least partially covering and protecting the at least one item;

a fluidly-sealed, fluidly-impervious container operatively coupled to an exterior surface of the cover; and contents of the container comprising at least one liquid;

wherein at least part of a front of the container is light-transmissive;

wherein the container front is flexible; and wherein the cover defines a cutaway section occupied at least partially by the container.

2. The fluid display assembly as in claim 1, the contents of the container further comprising at least one undissolved gas bubble.

3. The fluid display assembly as in claim 1, contents of the container further comprising at least one solid object.

4. The fluid display assembly as in claim 1, the at least one liquid comprising at least two immiscible liquids, each of said at least two liquids retaining a different appearance than any other of the at least two liquids.

5. The fluid display assembly as in claim 1, wherein the at least one item is selected from a group consisting of: paper sheets, paper pages, a pad of paper, lined paper, and printed paper.

6. The fluid display assembly as in claim 1, wherein the paper-supporting assembly is selected from a group consisting of: a pad, a letter pad, a binder, a ring binder, a view-binder, a clipboard binder, a notebook, a loose-leaf notebook, a book, a composition book, a spiral-bound book, a hard-bound book, a paperback book, a booklet, a file, a folder, a record book, a financial book, a ledger, an accounting book, an expense book, a journal, a drawing pad, a sketch pad, a memo book, an address book, a telephone book, a date book, an assignment book, a display book, a weekly planner, a monthly planner, a daily planner, a time-management book, a planner, a diary, a schedule book, a pocket calendar, a calendar, an organizer book, a portfolio pad, a report protector, an appointment book, a magazine holder, a photo album, and a menu.

7. The fluid display assembly as in claim 1, wherein the cover is selected from a group consisting of: a front of the paper-supporting assembly, a back of the paper-supporting assembly, and a spine of the paper-supporting assembly.

8. The fluid display assembly as in claim 1, wherein a portion of the cover cooperates with the container to provide at least a part of the container.

9. The fluid display assembly as in claim 1, comprising a display visible through the container front, the display comprising at least one member selected from a group consisting of: the contents of the container, an appearance of the container, an appearance of the cover, and an appearance of the at least one item.

10. The fluid display assembly as in claim 1, further comprising:

an auxiliary member operatively associated with the cover for accommodating an auxiliary display;

the auxiliary member selected from a group consisting of a sleeve, a pocket, and a slot;

the auxiliary member including a light-transmissive top portion; and the auxiliary member occupying a location selected from a group consisting of: a location not overlapping the container, a location at least partially overlapping and on top of the container, and a location at least partially overlapping and below the container.

* * * * *